US005542666A

United States Patent [19]

Chou

[11] Patent Number: 5,542,666

[45] Date of Patent: Aug. 6, 1996

[54] INSERTABLE HOSEL EXTENSION FOR VARYING OFFSET AND INSET OF GOLF CLUBS

[75] Inventor: Arthur C. P. Chou, Oceanside, Calif.

[73] Assignee: Acushnet Company, Fairhaven, Mass.

[21] Appl. No.: 372,401

[22] Filed: Jan. 13, 1995

[51] Int. Cl.[6] ..... A63B 53/02

[52] U.S. Cl. ..... 473/314

[58] Field of Search ..... 273/80 C, 167 G, 273/80.1, 80.2, 163 A, 164.1, 186.2, 187.2, 187.4

[56] References Cited

U.S. PATENT DOCUMENTS

| | | | |
|---|---|---|---|
| 3,980,301 | 9/1976 | Smith . | |
| 4,073,492 | 2/1978 | Taylor . | |
| 4,222,567 | 9/1980 | Shabala | 273/163 A |
| 4,265,452 | 5/1981 | Vella | 273/167 G |
| 4,655,457 | 4/1987 | Thompson . | |
| 4,852,879 | 8/1989 | Collins . | |
| 4,895,367 | 1/1990 | Kajita et al. . | |
| 4,984,794 | 1/1991 | Pernelle et al. . | |
| 5,004,237 | 4/1991 | Antonious . | |
| 5,106,088 | 4/1992 | Saito . | |
| 5,127,653 | 7/1992 | Nelson . | |
| 5,133,553 | 7/1992 | Divnick . | |
| 5,137,275 | 8/1992 | Nelson . | |
| 5,226,654 | 7/1993 | Solheim . | |
| 5,228,332 | 7/1993 | Bernhardt . | |
| 5,267,733 | 12/1993 | Szokola . | |
| 5,292,128 | 3/1994 | Solheim . | |
| 5,320,346 | 6/1994 | Phillips . | |
| 5,333,860 | 8/1994 | Saito et al. . | |
| 5,333,862 | 8/1994 | Teramoto et al. . | |

FOREIGN PATENT DOCUMENTS

| | | | |
|---|---|---|---|
| 1222263 | 5/1987 | Canada | 273/80.1 |
| 1232651 | 5/1971 | United Kingdom . | |
| 1363000 | 8/1974 | United Kingdom . | |

*Primary Examiner*—Sebastiano Passaniti
*Attorney, Agent, or Firm*—Pennie & Edmonds

[57] ABSTRACT

A golf club with a head and a shaft having a transitional hosel portion which portion is insertable for temporary engagement in the head and the shaft to permit selecting varying offsets and insets. Thereafter the engagement is made permanent.

9 Claims, 3 Drawing Sheets

INSERTABLE HOSEL EXTENSION FOR VARYING OFFSET AND INSET OF GOLF CLUBS

BACKGROUND OF THE INVENTION

It has been proposed to position the hosel and shaft at various locations with respect to the head for high impact clubs (U.S. Pat. No. 3,980,301). Similarly, a variety of hosel and shaft positions have been proposed for putters (U.S. Pat. Nos. 4,984,794 and 5,127,653) .

Further, clubs have been made which permit varying the loft of the face between shots by the player (U.S. Pat. No. 5,133,553).

SUMMARY OF THE INVENTION

Broadly, the present invention comprises a separate transitional golf club hosel which has an angled neck section. During assembly of the head, the transitional hosel is positioned in the head and in the shaft and oriented to the desired angle with respect to the head and the shaft. The transitional hosel is then affixed to the head and shaft.

It is a feature that the transitional hosel may include three sections: one section is insertable in the head hosel portion, one section is at an angle to the other two sections, and the third section is insertable in the shaft or alternatively receives the shaft.

DESCRIPTION OF THE PREFERRED EMBODIMENT

Figure 1:
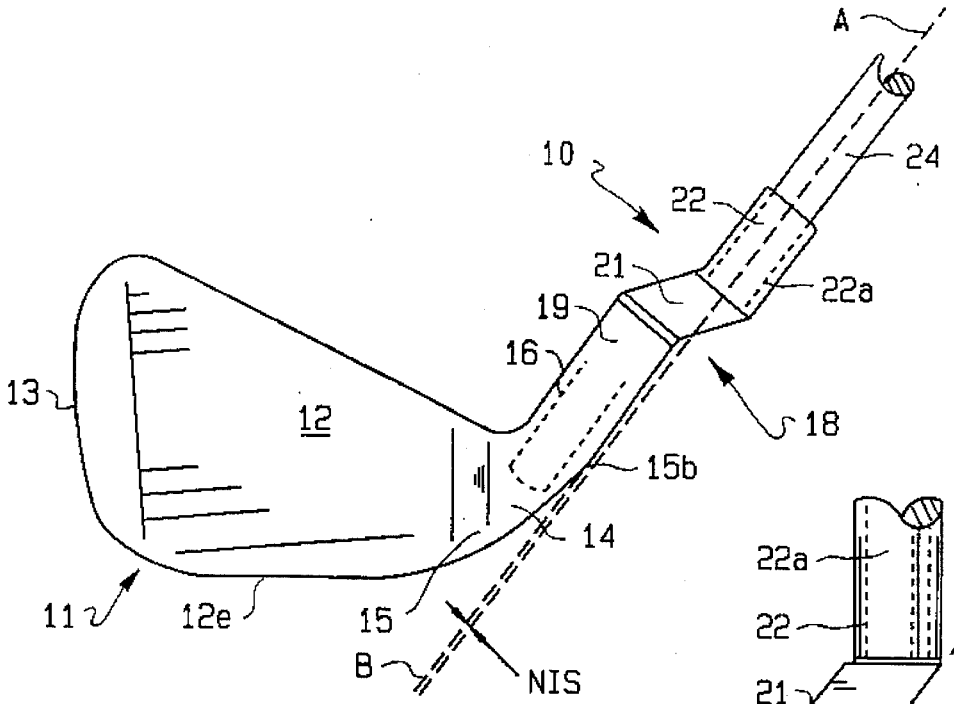
FIG. 1 is a partial front elevational view of an iron of the present invention including the positionable transitional hosel.

In FIGS. 1–5, golf club iron 10 includes head 11 which comprises ball striking area 12 and integral lower hosel portion 14. The lower and leading edge of striking area 12 is 12*e*. Head heel 15 includes back portion 15*b* most distant from toe 13. Lower hosel portion 14 has a cylindrical lower hosel recess 16 for receiving positionable hosel extension 18. Recess 16 may in an alternative construction be in head 11 with the lower hosel 14 being omitted.

Figure 1A:
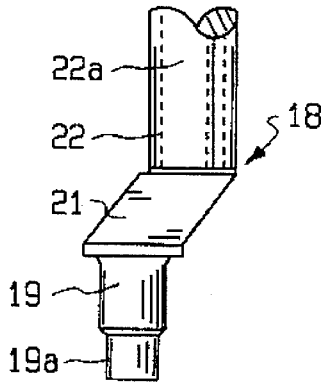
FIG. 1*a* is an elevational view of the positionable transitional upper hosel portion.
Figure 1B:
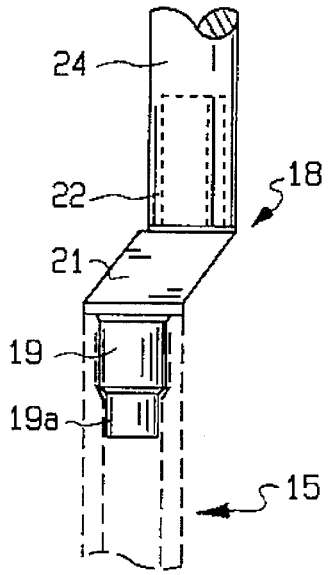
FIG. 1*b* is an elevational view of a second embodiment of the positionable transitional upper hosel portion.

Upper hosel portion 18 includes three (3) integrally formed sections: hosel attachment projection section 19 having taper 19*a*, angle neck offset section 21 and shaft receiving attachment section 22 (FIG. 1A). Section 22 has cylindrical neck recess 22*a* for receiving shaft 24 (see FIG. 5*a*). In a second embodiment, the shaft receiving attachment section 22 is inserted into shaft 24 (FIG. 1*b*).

Insertable positionable upper hosel portion 18 is capable of being angularly positioned relative to face area 12 and its leading edge 12*e* and relative to the most-away-from-the-toe heel portion 15*b* of head 11. By varying the position of upper hosel 18 as its projection 19 is inserted into recess 16 along a first axis (not shown) and turned to create the desired neck section 21 orientation, the inset and offset of club 10 can be varied from positive to zero to negative. Once positioned, as desired, projection 19 is secured in recess 16 and shaft 24 is secured in recess 22*a* by forced metal-to-metal fit, by use of adhesives or other permanent fixation means. Recess 22*a* along with shaft 24 has a second axis A. The line parallel to axis A which passes through portion heel 15*b* is line B. Angle selection and fixation may be accomplished at the factory, at a retail shop at the time of club purchase or elsewhere. It is contemplated that during the life of the club, the inset or offset might be again varied.

Figure 2:
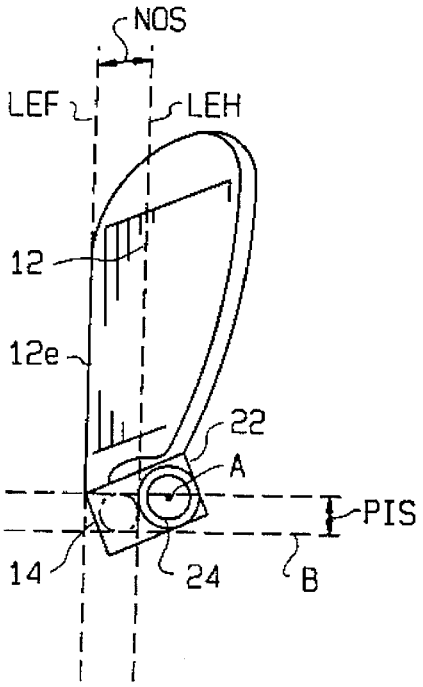
FIG. 2 is a plan view of such iron including the neck section of the upper hosel portion.

Upper hosel portion 18 including its neck section 21 is angled and positioned in FIG. 1 to create a distance between lines A and B which is negative inset (NIS). Inset distances from the back of the heel in a direction away from the toe 13 are herein referred to as "negative inset" distances. Inset is the distance from the portion of the heel 15*b* which portion is most remote from toe 13 to the center axis A of shaft-receiving section 22 (which is also the center axis of shaft 24). Upper hosel 18 is positioned in FIG. 2 to create a positive inset (PIS) and a negative offset (NOS). Offset in FIG. 2 is the distance from the leading edge 12*e* of the face area 12 (LEF) to the leading edge (LEH) of section 22 of positionable hosel extension 18.

Figure 3:
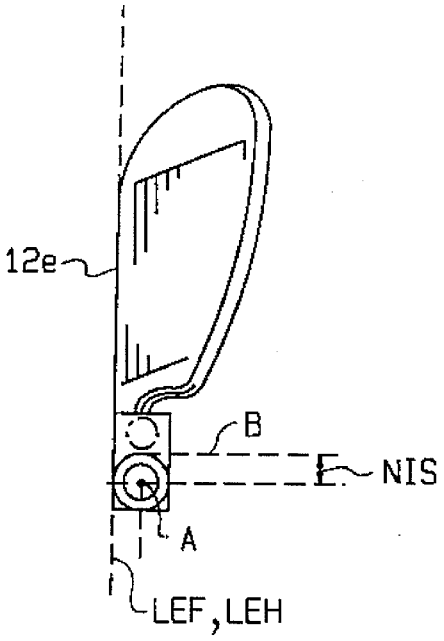
FIG. 3 is a plan view similar to FIG. 2 in which the neck section of the upper hosel is positioned to create negative inset and zero offset.
Figure 4:
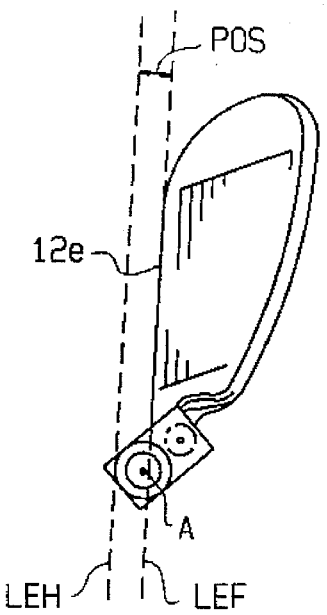
FIG. 4 is a plan view similar to FIG. 2 in which the neck section of the upper hosel is positioned to create positive offset and negative inset.

FIGS. 3 and 4 show alternative upper hosel 18 positions in recesses 16 and 22*a* to create zero offset and negative inset (NIS) in FIG. 3 and negative inset (NIS) and positive (POS) offset in FIG. 4.

Figure 5:
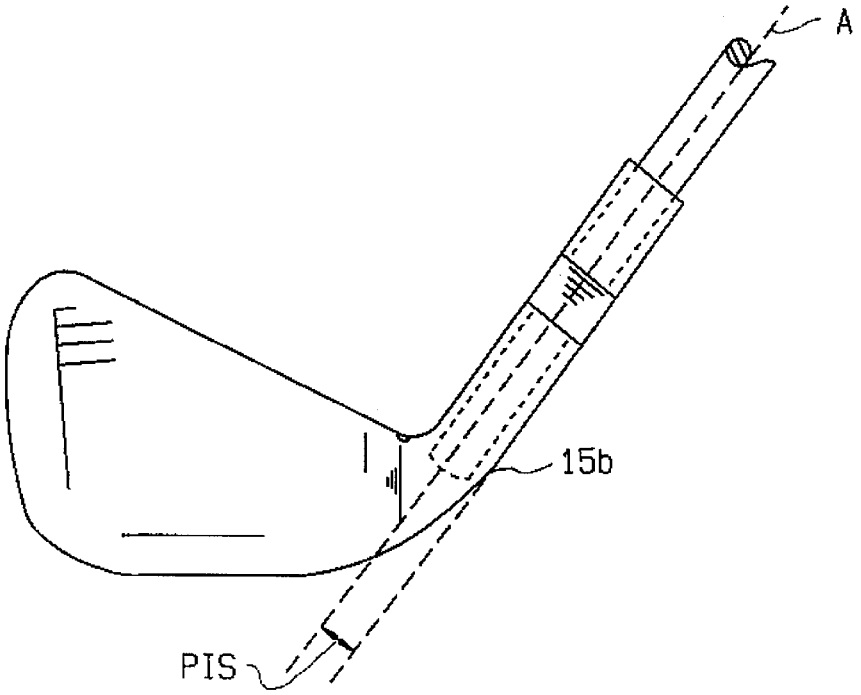
FIG. 5 is a view similar to FIG. 1 in which the hosel extension is positioned to create zero inset.
Figure 6:
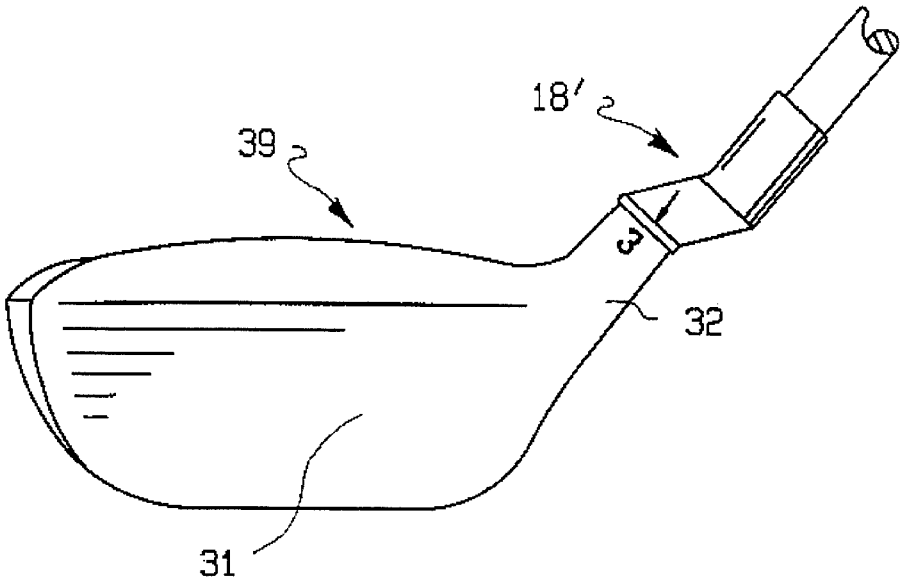
FIG. 6 is a view of the present invention in which the club is a wood-type club.

FIG. 5 depicts insert 18 positioned to create positive inset (PIS) and FIG. 6 shows the inventive positionable insert 18' used on wood-type club 39 having head 31 including integral hosel 32. Club 39 may be made of wood, metal or a composite of materials.

Figure 7:
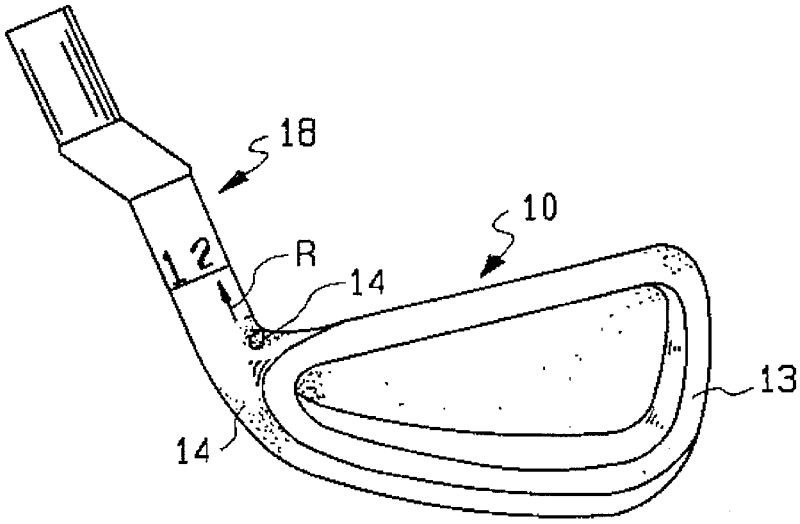
FIG. 7 is a view of the present invention in which the club is an iron-type club.

Finally, FIG. 7 shows upper hosel portion 18 readily alignable to selected positions with lower hosel 14, which has on it arrow mark R. By dialing unit 18, with numerical markings 1, 2, etc. around its circumference, to selected alignment with arrow R is readily obtainable. Hosel portion 18 once so aligned is secured to lower hosel 14.

I claim:

1. In a non-putter golf club having a head with a ball striking surface with a leading edge, the head having a heel, a lower hosel portion and a hosel recess in the lower hosel portion along a first axis, and a shaft with a second axis, the improvement comprising:

a transitional hosel portion positionable in the hosel recess and including;

a first attachment means for insertion in the hosel recess along said first axis;

a second attachment means for insertion with the shaft along the second axis; and an angled neck section positioned between the first and second attachment means of the transitional hosel portion to permit said first and second axes to be selectively positioned in varying alignment among i) said axes, ii) the leading edge of the transitional hosel, iii) the heel and iv) the leading edge of the ball striking surface.

2. In the golf club of claim 1 having three separate elements prior to assembly consisting of the head, the shaft and the transitional hosel.

3. The club of claim 2 in which the first attachment means is capable of being inserted into the head, is capable of thereafter being moved relative to the head and is securable to the head.

4. The club of claim 2 in which the second attachment means is capable of being inserted into the shaft, is capable of thereafter being moved relative to the shaft and is securable to the shaft.

5. The club of claim 4 in which the second attachment means and the lower hosel portion have markers thereon.

6. The club of claim 2 in which the second attachment means is capable of receiving the shaft, is capable of thereafter being moved relative to the shaft and is securable to the shaft.

7. The club of claim 1 in which the first attachment means is a hosel projection.

8. The club of claim 1 in which the second attachment means is a hosel recess.

9. The club of claim 1 in which the transitional hosel portion is positioned to provide a club with inset and offset.

* * * * *